United States Patent [19]

Jackson et al.

[11] 4,144,009

[45] Mar. 13, 1979

[54] APPARATUS FOR PRODUCTION OF METAL STRIP

[75] Inventors: George Jackson, Dronfield Woodhouse; John Wooddisse, Hathersage, both of England

[73] Assignee: British Steel Corporation, London, England

[21] Appl. No.: 816,796

[22] Filed: Jul. 18, 1977

[30] Foreign Application Priority Data

Jul. 16, 1976 [GB] United Kingdom ..... 29776/76

[51] Int. Cl.[2] ..... B22F 3/18

[52] U.S. Cl. ..... 425/79; 425/363; 425/367; 425/371

[58] Field of Search ..... 425/79, 363, 367, 371

[56] References Cited

U.S. PATENT DOCUMENTS

| | | | |
|---|---|---|---|
| 2,758,336 | 8/1956 | Franssen | 425/79 |
| 2,904,829 | 9/1959 | Heck | 425/79 |
| 2,919,466 | 1/1960 | Roemer | 425/79 |
| 3,144,681 | 8/1964 | Krantz et al. | 425/79 |
| 3,203,045 | 8/1965 | Nalser et al. | 425/79 |
| 3,298,060 | 1/1967 | Michalok | 425/367 X |
| 3,412,428 | 11/1968 | Marx | 425/367 |
| 3,754,849 | 8/1973 | Fox | 425/363 |
| 3,988,095 | 10/1976 | Mersch et al. | 425/363 |

FOREIGN PATENT DOCUMENTS

| | | | |
|---|---|---|---|
| 1087457 | 10/1967 | United Kingdom | 425/79 |

*Primary Examiner*—J. Howard Flint, Jr.
*Attorney, Agent, or Firm*—Bacon & Thomas

[57] ABSTRACT

For the production of strip material particulate metalliferous material is fed from a hopper into and through the roll gap formed between a pair of contra-rotating compaction rolls. The ends of the roll gap are closed off by means of endless belts which engage the opposite end faces of the compaction rolls and in order to counteract the tendency of particulate material to be drawn into the end zones of the roll gap by the endless belts means are provided for restricting the flow of particulate material to these end zones. By the provision of such restricting means the rate at which particulate material enters the roll gap is substantially uniform along its entire length.

15 Claims, 12 Drawing Figures

APPARATUS FOR PRODUCTION OF METAL STRIP

Figure 1:
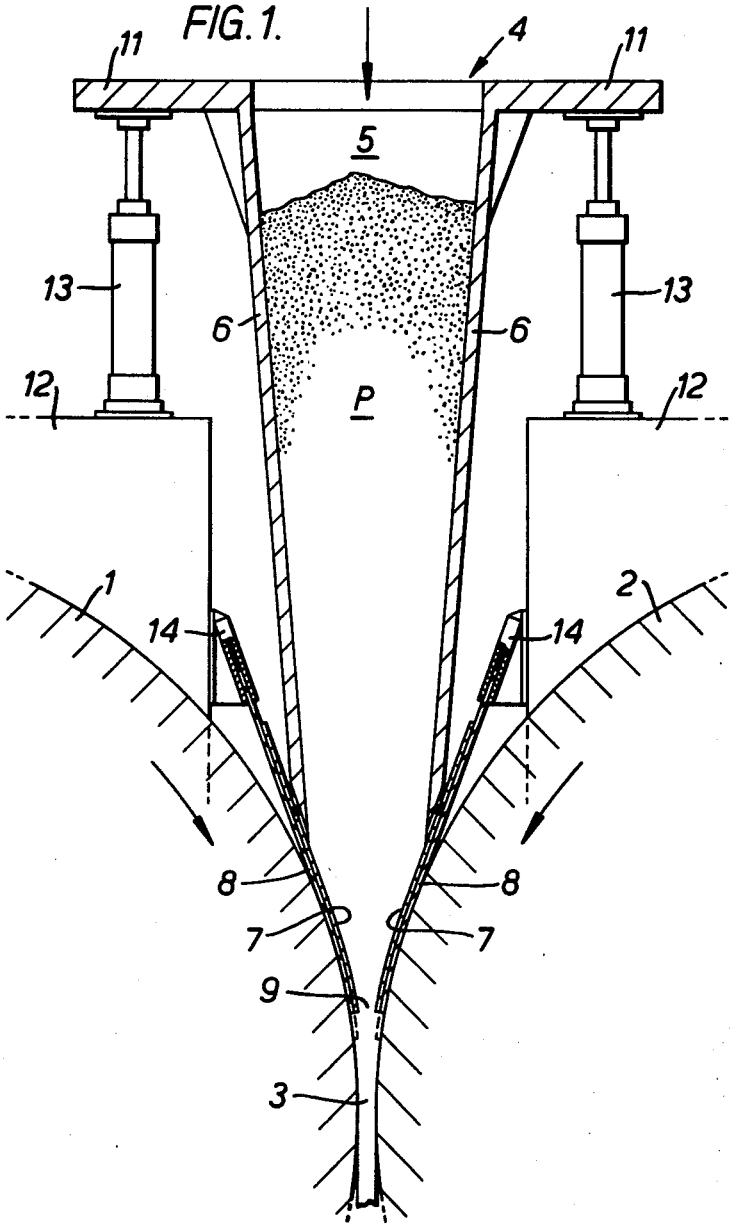

This invention relates to the production of metal strip or sheet and more particularly to the compaction of particulate metalliferous material into strip or sheet form (hereinafter referred to simply as strip). More especially, but not exclusively, the invention relates to the roll compaction of metallic powder into strip. The term "metalliferous material" as used herein includes metals, metal containing and metal bearing materials.

Conventionally, a compaction mill includes a pair of rolls mounted with their rotational axes spaced in a substantially horizontal plane to define a roll gap therebetween; particulate material, eg. metal powder, is fed into the mill from a hopper mounted with its discharge orifice positioned above the roll gap of the mill. To confine powder to the roll gap it is necessary to seal the spacing between the ends of the rolls.

Previous proposals for sealing these spaces have included use of endless belts which frictionally engage the opposed end surfaces of the rolls from points above to the bottom of the roll gap. The belts extend into openings formed in the end walls of the hopper and an adjustably mounted strip is located within each opening to regulate the surface area of belt in contact with the powder within the hopper. Other proposals for sealing the ends of the roll gap have included the use of rolls provided with overlapping flanges at their ends and discs rotatable so that their peripheries engage the opposed end surfaces of the rolls in the region of the roll gap.

These proposals all suffer from the disadvantages that the belts, flanges or rotating discs tend to draw increasingly excessive amounts of powder into the end zones of the roll gap as the rolling speed of the mill increases. The rate at which powder enters the roll gap is consequently not uniform across the length of the roll gap which leads to strip being produced of uneven thickness and density. In extreme cases the increased flow of powder to the end zones of the roll gap can result in roll failure due to the high local pressures generated.

The presence of the previously mentioned adjustable strips to regulate the surface area of belt in contact with the powder in the hopper only partially alleviates the problem of increased powder flow into the end zones of the roll gap since even relatively a small surface area of belt exposed to the powder draws powder into the roll gap end zones at a significantly greater rate than flows by gravity into the roll gap intermediate the end zones. In consequence, the edges of the strip emerging from the compaction mill are of increased density thus necessitating trimming to achieve the required consistent density and thickness across the width of the strip.

According to the present invention in one aspect, there is provided apparatus for compacting particulate metalliferous material into strip form which comprises a pair of compaction rolls mounted with their rotational axes spaced in a substantially horizontal plane to define a roll gap therebetween, movable endless belts positioned one at each end of the roll gap in engagement with the end faces of the rolls to close off the ends of the roll gap, a hopper having a discharge orifice for feeding particulate material to the roll gap mounted with said discharge orifice positioned above and extending across substantially the full length of the roll gap, the hopper having sidewalls with lower margins extending along the length of the roll gap, a shielding plate assembly extending below and adjacent the lower margin of each side wall of the hopper, means for effecting relative movement between the shielding plate assemblies and the hopper side walls whereby the lower margin of each shielding plate assembly can protrude at least partially below the lower margin of the respective hopper side wall to define the lengthwise extending boundaries of the discharge orifice of the hopper, and means extendable into the end zones of the roll gap for restricting the flow of particulate material to the end zones of the roll gap to counteract the tendency of particulate material to be drawn into these end zones by the endless belts thereby to maintain the rate at which particulate material enters the roll gap substantially uniform along its entire length.

In a preferred arrangement, the lower margins of the hopper side walls and shielding plate assemblies are so shaped that together they define lengthwise extending discharge orifice boundaries which protrude downwardly at their ends to restrict flow of particulate material to the end zones of the roll gap. The lower margin of each shielding plate assembly may be symmetrically shaped about its mid-point to define downwardly protruding end portions and the lower margins of the hopper side walls may lie in a common substantially horizontal plane or vice versa. The hopper side walls may carry flexible extensions which engage or lie adjacent the barrel surfaces of the rolls.

Preferably, the shielding plate assemblies are slidably mounted behind the hopper side walls. Means may additionally be provided for raising and lowering the hopper relative to the roll gap.

In one embodiment of the invention, each shielding plate comprises a flat plate of width substantially equal to that of its respective side wall. In an alternative embodiment each shielding plate assembly comprises a pair of downwardly extending strips which are movable to protrude below the lower margin of the adjacent side wall at the end thereof.

In an alternative construction, surfaces of each hopper side wall and/or shielding plate assembly which lie above the end zones of the roll gap are roughened or coated with a high friction material to resist the flow of particulate material to the end zones of the roll gap.

The surface area of each endless belt in contact with the particulate material in the hopper may be varied by means of an adjustably mounted shutter provided with a high friction surface. Alternatively, each adjustably mounted shutter may have a surface which protrudes into the space immediately above one end zone of the roll gap to restrict flow of particulate material into said end zone.

A further aspect of the invention involves a method of producing strip by compacting particulate metalliferous material comprises the steps of feeding particulate material into a roll gap defined between a pair of compaction rolls mounted with their rotational axes spaced in a substantially horizontal plane, closing off the ends of the roll gap by means of endless belts positioned one at each end of the roll gap in engagement with the end faces of the rolls, controlling the rate of feed of particulate material to the roll gap by varying the area of roll surface exposed to the particulate material, and restricting the flow of particulate material to the end zones of the roll gap to counteract the tendency of particulate material to be drawn into these end zones by the endless belts thereby to maintain the rate at which particulate material enters the roll gap substantially uniform along its entire length.

The flow properties of the particulate material within the hopper may be varied differentially accross the length of the hopper by suitable addition of a solid (eg. graphite), liquid (eg. oil or water) or gaseous agent.

In a still further aspect, the invention provides apparatus for compacting metallic powder into strip form which comprises a compaction mill, movable endless belts positioned one at each end of the roll gap of the mill in frictional engagement with the end faces of the mill rolls to close off the ends of the roll gap, a powder feed hopper mounted with its discharge orifice position above and extending across substantially the full length of the roll gap of the mill, shielding plate assemblies positioned one behind each side wall of the hopper and movable relative thereto to positions in which they at least partially protrude below the lower margin of the hopper side walls to define the lengthwise extending boundaries of the discharge orifice of the hopper, and means for restricting the flow of powder to the end zones of the roll gap to counteract the tendency of powder to be drawn into these end zones by relative movement between the endless belts and powder entering the roll gap.

In a preferred use of the apparatus and operation of the method described above, the particulate material consists of metallic powder, eg. iron, mild or stainless steel, nickel, copper, aluminium, or metalliferous ore. The powder may be produced by a water-atomisation technique.

Figure 2:
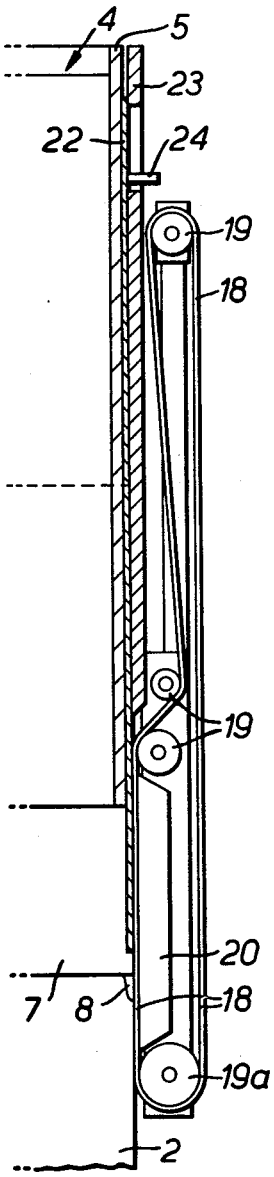
Figure 3A:
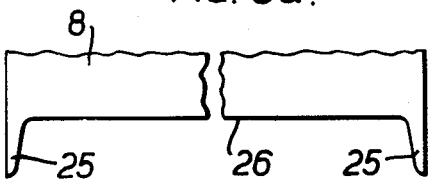
Figure 3B:
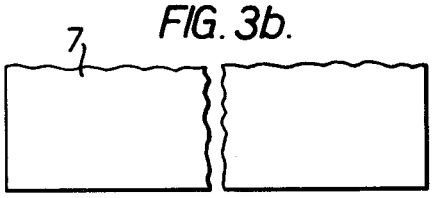
Figure 3C:
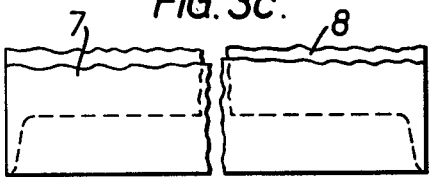
Figure 3D:
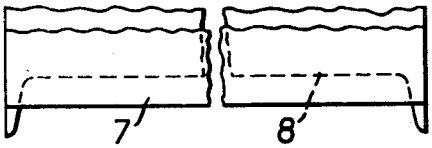
Figure 3E:
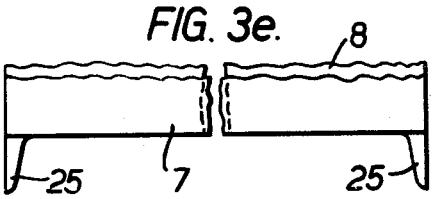
Figure 4A:
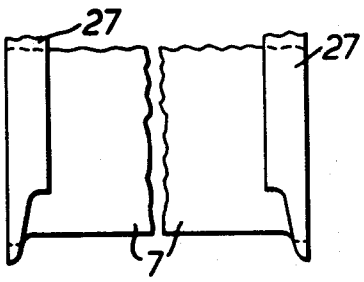
Figure 4B:
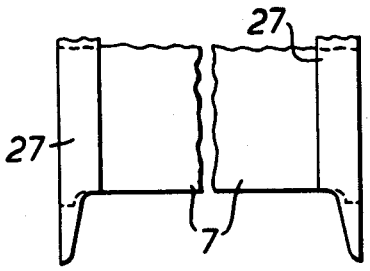
Figure 5:
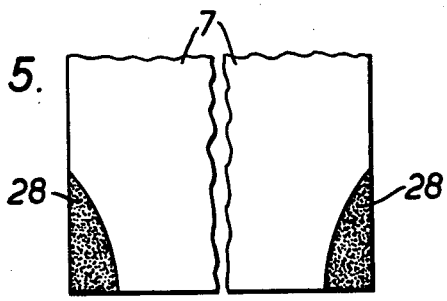
Figure 6A:
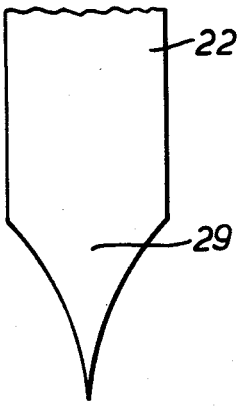
Figure 6B:
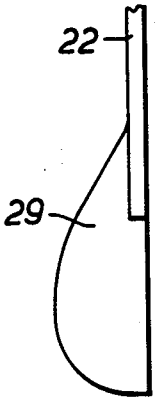

The invention will now be described by way of example with reference to the accompanying diagrammatic drawings in which:

FIG. 1 is a side elevational view in section of apparatus in accordance with the invention, FIG. 2 is a side elevational view of an edge belt and shutter assembly used to retain metal powder within the sides of the roll gap of the mill illustrated in FIG. 1, FIGS. 3*a* and 3*e* are front elevational views of hopper side walls and associated shielding plate assemblies employed in the mill illustrated in FIG. 1, FIGS. 4*a* and 4*b* illustrate alternative hopper side wall and shielding plate assemblies to those illustrated in FIGS. 3*a* to 3*e*, FIG. 5 shows a front elevational view of an alternative shielding plate assembly in accordance with the invention, and FIGS. 6*a* and 6*b* are respectively plan and side views of an alternative form of shutter assembly to that illustrated in FIG. 2.

The invention will be described with reference to the production of metal strip by roll compacting metal (eg. steel) powder produced by a water-atomisation technique. Where appropriate, throughout the following description, like integers bear the same reference numerals.

The compaction mill illustrated in FIG. 1 includes a pair of co-operating contra-rotating rolls 1,2 which together define a roll gap 3 therebetween and which are mounted with their rotational axes spaced apart in a substantially horizontal plane. The roll gap 3 may be varied by movement of one roll towards or away from the other in a known manner.

A hopper 4 is mounted above the rolls 1,2 to feed metal powder P into the roll gap 3. The hopper 4 comprises end walls 5 extending along the roll gap length and between which are mounted two inwardly inclined side walls 6 carrying flexible extensions 7 which project part-way into the entry portion of the roll gap 3. Positioned behind each hopper side wall 6 is a shielding plate assembly 8. These shielding plate assemblies 8 and the flexible extensions 7 of the hopper side walls 6 are preferably manufactured from springy metal and are curved particularly at their lower ends so that they engage the barrel surfaces of the rolls 1,2 in the vicinity of the roll gap 3. The shielding plate assemblies 8 and the flexible extensions of the side walls together define the lengthwise extending boundaries of a slot 9 through which powder P present in the hopper 4 is fed into the roll gap 3. The slot 9 extends over the full length of the roll gap 3.

The hopper 4 is formed at its upper end with flanges 11 which extend outwardly to positions above the roll chocks 12. Hydraulic jacks 13 are positioned between the opposed surfaces of the flanges 11 and chocks 12 and are operable to move the hopper 4 towards or away from the roll gap 3.

Each shielding plate assembly 8 is slidably mounted at its upper end within a guide 14 secured to a side face of one of the roll chocks 12. The shielding plate assemblies 8 can be moved into, or out of, the roll gap 3 by means of a motor (not shown) mechanically coupled to the assemblies 8. The width of the slot 9 and the extent of roll barrel surface exposed to the powder can thereby be altered to vary the rate at which powder is fed into the roll gap.

As shown in FIG. 2, the ends of the roll gap 3 are closed by endless belts 18 which track around idle pulleys 19 and frictionally engage the opposed end faces of the rolls 1, 2 in the vicinity of the roll gap. Sufficient drive may be applied to the belts to overcome the mechanical resistance of the pulleys and to ensure that the speeds of the belts are matched to the speeds of the rolls. Each belt 18 is urged by its respective lower pulley 19a into contact with one pair of end faces of the rolls 1,2 between positions above and just below the bottom of the roll gap 3 so as to seal off the ends of the roll gap. An adjustable skid 20 is provided to maintain tight contact between each belt 18 and the respective opposed end faces of the rolls. Shutters 22 are mounted within channels defined between the opposed surfaces of the end walls 5 and plates 23 secured to the end walls and are movable vertically to regulate the surface area of belt 18 in contact with the powder within the hopper 4. Movement of the shutters is effected by pegs 24 located in suitably shaped slots formed in the plates 23.

FIGS. 3*a* and 3*b* illustrate the shaping applied to the lower edges of each shielding plate 8 and each flexible extension 7 of the hopper side wall 6 and FIGS. 3*c* to 3*e* illustrate the positions taken up by each shielding plate 8 with respect to its associated side wall 7 during, respectively, start-up, slow speed and normal operating speed of the mill.

As will be seen from FIG. 3*a* the lower margin of the shielding plate 8 is shaped at its ends to provide two downwardly protruding ears 25, the central length 26 of the margin being generally straight. The shaping is symmetrical about the mid-point of the shielding plate lower margin. From FIG. 3*b* it will be seen that the lower margin of the side wall 7 follows a straight line normal to the side edges of the wall 7. In an alternative arrangement, the lower margin of the shielding plate may follow a concave curve over its entire length.

At start-up of the mill each shielding plate 8 is positioned behind its associated side wall 6 so that lengthwise-extending boundaries of the feed slot 9 of the hopper are defined solely by the lower margins of the flexible extensions 7 of the hopper side walls. As the mill accelerates, the hopper 4 is raised to increase the flow of powder to the roll gap; simultaneously each shielding plate is lowered relative to the hopper so that its depending ears 25 partially overlap the lower margin of its associated side wall extension. The protruding ears 25 shield the powder approaching the end zones of the roll gap from the rolls 1,2 thereby offsetting the tendency of the edge belts 18 to draw powder into these end zones thereby to maintain the rates at which powder enters the roll gap substantially uniform along its entire length. When operating at the normal operating speed of the mill, the ears 25 of the shielding plates 8 protrude completely below the lower margins of the flexible extensions 7 so that the lengthwise-extending boundaries of the feed slot 9 are now defined by the lower edges of the shielding plates; again, the fully protruding ears 25 restrict the flow of powder into the end zones of the roll gap to balance the tendency of powder to be drawn into these end zones by the belts 18. Thus, at all speeds intermediate start-up and normal running speed, the ears 25 restrict the flow of powder to the end zones of the roll gap to enable normal running speed to be achieved without high density bands of powder appearing at the edges of the roll gap.

If, as in conventional mills, the lengthwise-extending boundaries of the hopper feed slot 9 were, at all mill operating speeds, defined by shielding plates or hopper side walls having straight lower edges similar to the side wall edge shown in FIG. 3*a*, then the rate of feed of powder to the end zones of the roll gap 3 would gradually increase with increasing mill speeds due to the effect of the edge belts 18. In the embodiment described above, it will be appreciated that the protruding ears 25 of the shielding plates 8 reduce the area of roll surface exposed to the powder exiting from the end regions of the hopper feed slot 9, thereby restricting the rate at which powder is fed by the rolls towards the end zones of the roll gap. This restriction off-sets the feeding effect which the edge belts have on the powder adjacent these end zones.

In an alternative embodiment to that illustrated in FIGS. 1 to 3, the shielding plates 8 remain stationary during operation of the mill and the hopper 4 is raised and lowered relative to the shielding plates to vary the configuration of the lengthwise-extending boundaries of the feed slot 9 in the manner set out above. In either case, the shaping shown in FIG. 3*a* applied to the shielding plate may alternatively be applied to the lower edges of the flexible extensions 7 of the hopper side walls 6.

In a further alternative unillustrated embodiment, the ears 25 may be surfaced with a high friction material (by suitable coating or treatment) to inhibit further the flow of powder to the end zones of the roll gap. In this embodiment, the ears 25 need not protrude to the same extent as they would if they were not so coated or treated.

In the embodiment illustrated in FIGS. 4*a* and 4*b* each shielding plate assembly comprises a pair of side strips 27 which, in operation of the mill, protrude below the lower margin of the hopper side wall flexible extensions 7. The end of the strips 27 and the ends of the lower margin of the side wall extensions 7 are shaped to provide a smooth transition at the slow-speed mill operating position shown in FIG. 4*a* and at the normal operating position shown in FIG. 4*b*.

In the arrangement illustrated in FIG. 5 each side wall extension 7 (or alternatively each shielding plate) is surfaced at its lower outer edge with a high friction material 28 such as emery cloth. The high friction material restricts the flow of powder into the end zones of the roll gap. In an alternative construction the outer lower edges of the side walls of the shielding plates may be roughened by a machining, shot blasting or similar treatment.

Turning now to FIGS. 6*a* and 6*b*, each shutter 22 is formed on its surface facing the roll gap 3 with a curved protrusion 29 which extends into the entry region of the roll gap above the roll gap end zones to restrict the flow of powder into these end zones. Movement of the shutters towards and away from the roll gap 3 respectively increases and decreases the restrictions imposed by the shutters on the rate at which powder flows to the end zones of the roll gap. The shutters 29 may be used in combination with the shaped shielding plates or hopper side walls described hereinbefore. As will be seen from FIG. 6*a* the base of the shutter is shaped so that it just clears the shielding plates and rolls when the shutter is at its lowest position and when the rolls are touching.

In a further embodiment of the invention, restriction of the flow of particulate material to the end zones of the roll gap is effected by suitable variation of the flow properties of the material within the hopper. Thus, a suitable solid (e.g. graphite), liquid (e.g. oil or water) or gaseous agent may be added to the powder in the hopper differentially to vary its flow characteristics.

In each of the foregoing arrangements, it will be appreciated that the relative settings of the hopper, the shielding plate assemblies and the edge belt shutters are changed during changes of mill speed so as to control the flow of particulate material to the roll gap to maintain the rate at which particulate material enters the roll gap substantially uniform along its entire length. When producing strip of a given thickness and density the total mass of particulate material fed to the roll gap per unit time will be increased as rolling speed increases.

The shielding plates may be positioned behind their respective hopper walls instead of in front of these walls as previously described. Alternatively, the shielding plates may extend from behind through slots formed in the hopper walls so that their lower portions lie in front of the lower portions of the hopper walls.

The relative positions of the hopper, shielding plate assemblies and edge belt shutter may, for example, be controlled as the mill accelerates and de-accelerates in relation to the instantaneous values of roll speed by reference to previously established empirical relationships for the particular type of strip being roll compacted.

Alternatively, their relative positions may be controlled by providing control signals derived from sensors which measure the thickness and density of the roll compacted strip as it emerges from the mill. In practice a series of such sensors, or one or more scanning sensors could be used to provide information on thickness and density across the full width of the strip.

These two methods may be used in combination by, for example, controlling the hopper, shielding plate assembly and edge belt shutter settings according to the predetermined relationship with roll speed and making fine adjustments from signals derived from the thickness and density sensors.

It will be appreciated that other known methods of control may be applied.

We claim:

1. Apparatus for compacting particulate metalliferous material into strip form comprising a pair of compaction rolls having end faces mounted with their rotational axes spaced in a horizontal plane to define a roll gap therebetween, movable endless belts positioned one at each end of the roll gap in engagement with the end faces of the rolls to close off the end zones of the roll gap, a hopper having a discharge orifice for feeding particulate material into the roll gap mounted with said discharge orifice positioned above and extending across the full length of the roll gap the hopper having side walls with lower margins extending along the length of the roll gap, a shielding plate assembly extendable below and adjacent the lower margin of each side wall of the hopper, means for effecting relative movement between the shielding plate assemblies and the hopper side walls whereby the lower margin of each shielding plate assembly can protrude at least partially below the lower margin of the respective hopper side wall to define the lengthwise extending boundaries of the discharge orifice of the hopper, and means extendable into the area above the end zones of the roll gap below the hopper for restricting the flow of particulate material into the end zones of the roll gap adjacent the end faces of the rolls to counteract the tendency of particulate material to be drawn into these end zones by the endless belts thereby to maintain the rate at which particulate material enters the roll gap substantially uniform along its entire length.

2. Apparatus as claimed in claim 1 wherein the lower margins of the hopper side walls and shielding plate assemblies are so shaped that together they define lengthwise extending boundaries which protrude downwardly at their ends to provide said means extendable into the area above the end zones of the roll gap for restricting the flow of particulate material into the end zones of the roll gap.

3. Apparatus as claimed in claim 2 wherein the downwardly protruding ends are defined by the lower margin of each shielding plate assembly being symmetrically shaped about is mid-point to define downwardly protruding end portions of each shielding plate assembly.

4. Apparatus as claimed in claim 2 wherein the downwardly protruding ends are defined by the lower margin of each hopper side wall being symmetrically shaped about its mid-point to define downwardly protruding end portions of each hopper side wall.

5. Apparatus as claimed in claim 1 wherein the hopper side walls carry flexible extensions which extend towards the roll gap adjacent the barrel surfaces of the rolls.

6. Apparatus as claimed in claim 1 wherein the shielding plate assemblies are slidably mounted behind the hopper side walls.

7. Apparatus as claimed in claims 1 wherein means are provided for raising and lowering the hopper relative to the roll gap.

8. Apparatus as claimed in claims 1 wherein each shielding plate assembly comprises a flat plate of width substantially equal to that of the adjacent side wall.

9. Apparatus as claimed in claim 1 wherein each shielding plate asembly comprises a pair of downwardly extending strips which are movable to protrude below the lower margin of the adjacent side wall at the ends thereof to provide said means extendable into the area above the end zones of the roll gap.

10. Apparatus as claimed in claim 1 wherein the inner surfaces of each hopper side wall which lie above the end zones of the roll gap have a high friction coefficient to resist the flow of particulate material to the end zones of the roll gap.

11. Apparatus as claimed in claim 1 wherein the surfaces of each shielding plate assembly which lie above the end zones of the flow gap have a high friction coefficient to resist the flow of particulate material to the end zones of the roll gap.

12. Apparatus as claimed in claim 1 wherein an adjustably mounted shutter is mounted adjacent each endless belt and is movable to vary the surface area of the endless belt in contact with the particulate mateiral in the hopper.

13. Apparatus as claimed in claim 12 wherein the surface of the shutter which in use lies in contact with the particulate material contained in the hopper is provided with a high friction surface.

14. Apparatus as claimed in claim 12 wherein each adjustably mounted shutter has a surface which protrudes into the space immediately above the respective adjacent end zone of the roll gap to provide said means extendable into the area above the end zones of the roll gap for restricting flow of particulate material into said end zone.

15. Apparatus for continuously compacting metal powder into strip form comprising a compacting mill having parallel, adjacent rolls defining a roll gap therebetween, the rolls having end faces adjacent the end zones of the roll gap, movable endless belts positioned one at each end of the roll gap of the mill in frictional engagement with the end faces of the mill rolls to close off the ends of the roll gap, a powder feed hopper having sidewalls with lower margins extending along the length of the roll gap and a discharge orifice positioned above and extending across the roll gap of the mill, shielding plate assemblies positioned one behind each side wall of the hopper and movable relative thereto to positions in which said shielding plate assemblies at least partially protrude below the lower margins of the hopper side walls to define the lengthwise extending boundaries of the discharge orifice of the hopper, and means extendable into the area above the end zones of the roll gap below the hopper for restricting the flow of powder into the end zones of the roll gap adjacent the end faces of the rolls to counteract the tendency of powder to be drawn into these end zones by relative movement between the endless belts and powder entering the roll gap.

* * * * *